United States Patent [19]

Annovi

[11] 4,095,354

[45] Jun. 20, 1978

[54] CONNECTOR FOR A REMOVABLE SKI BOOT FASTENING LOOP

[75] Inventor: Giuseppe Annovi, Montebelluna, Italy

[73] Assignee: Calzaturificio Giuseppe Garbuio S.A.S., Montebelluna, Italy

[21] Appl. No.: 753,373

[22] Filed: Dec. 22, 1976

[30] Foreign Application Priority Data

Dec. 29, 1975 Italy ..... 62072/75[U]

[51] Int. Cl.[2] ..... A43B 11/00; A44B 21/00

[52] U.S. Cl. ..... 36/50; 24/69 SK; 24/68 SK; 24/201 HE

[58] Field of Search ..... 24/70 SK, 69 SK, 68 SK, 24/201 HE; 36/50

[56] References Cited

U.S. PATENT DOCUMENTS

| | | | |
|---|---|---|---|
| 3,967,391 | 7/1976 | Kastinger | 36/50 |
| 4,011,634 | 3/1977 | Olivieri | 24/70 SK |
| 4,011,637 | 3/1977 | Mazur | 24/224 R |
| 4,020,571 | 5/1977 | Olivieri | 36/50 |

FOREIGN PATENT DOCUMENTS

| | | | |
|---|---|---|---|
| 1,520,342 | 2/1968 | France | 24/68 TK |
| 438 of | 1871 | United Kingdom | 24/201 HE |

*Primary Examiner*—Bernard A. Gelak
*Attorney, Agent, or Firm*—D. Paul Weaver

[57] ABSTRACT

A connector for a removable ski boot fastening loop embodies an engagement element for the loop on one side of the boot vamp and provided at its base with a guide and retaining groove into which the loop is removably inserted by forceable snapping.

4 Claims, 3 Drawing Figures

CONNECTOR FOR A REMOVABLE SKI BOOT FASTENING LOOP

BACKGROUND OF THE INVENTION

This invention relates to a connector for a removable ski boot fastening loop.

Fasteners for ski boots are known comprising a removable loop or ring coupled to an element provided on one side of the vamp, and a lever provided with teeth for engaging the loop and rigid with the other side of the vamp. As the loop must remain connected to the relative element even when the boot is undone, known boots usually comprise a band in a position corresponding with each element, the band being disposed parallel to the edge of the vamp and at a small distance therefrom. In this manner, the band retains the loop and prevents it from separating from the element even when the fastening lever is disengaged.

One disadvantage of this type of fastening loop connector is that the loop is unable to rotate about it anchoring element because of the band, and therefore cannot arrange itself in the direction of traction which the lever exerts upon it.

A further disadvantage is that the insertion of the loop under the band and its connection to the element can be somewhat laborious, especially if the loop is flexible.

A final disadvantage is that the presence of the band alters the linearity of the boot shape and thus constitutes an aesthetically negative element.

SUMMARY OF THE INVENTION

According to the present invention, the above disadvantages are obviated in a connector for a removable ski boot fastening loop comprising an engagement element for said loop rigid with one side of the boot vamp and provided at its base with a guide and retainer groove into which the loop is snappingly inserted by force.

DETAILED DESCRIPTION

Figure 1:
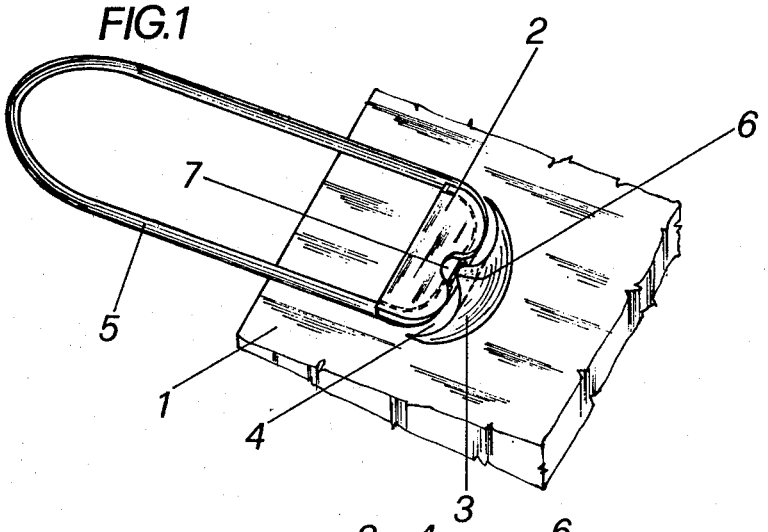
FIG. 1 is a perspective view of a portion of one vamp side provided with the connector for the ski boot fastening loop.
Figure 2:
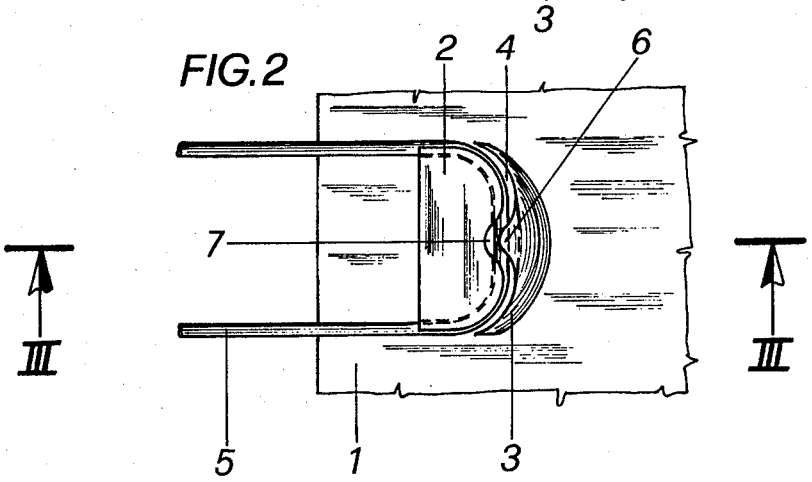
FIG. 2 is a fragmentary plan view of the same.
Figure 3:
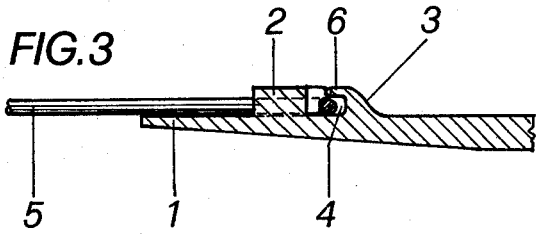
FIG. 3 is a vertical section taken on line 3—3 of FIG. 2.

Referring to the drawings in detail wherein like numerals designate like parts, an appendage 2 or element of mushroom-like form and being roughly semi-circular in plan is provided for each fastening loop 5 on one side 1 of the vamp. The vamp is constructed by traditional injection molding means. The curvature of the element 2 faces the opposite direction to the fastening lever, not shown, which is fitted to the other side of the vamp. At the base of the element 2, the vamp is provided with a rib 3 parallel to said base and arranged to define with the latter a curved groove 4 having an entrance narrower than the diameter of the cable which forms the fastening loop 5.

The rib 3, which is fixed relative to the element 2, is provided with tooth 6 which extends into a complementary notch 7 in the head of the element 2. The distance between the facing edges of the tooth 6 and notch 7 is substantially equal to the distance between the facing edges of the rib 3 and head of the element 2.

To engage the loop 5 with the element 2, the loop is forcibly inserted into the groove 4, which, because of its size, allows the loop 5 to enter by snapping while allowing freedom for the loop to rotate about the base of the element 2 and upwardly from the vamp 1 so that the loop can be aligned with the axis of force exerted by the fastening lever, not shown.

The purpose of the tooth 6 is to retain the fastening loop 5 in the groove 4 even when its disengages the element 2, for example, whenever the skier holds the boot hanging from one of the loops 5.

From the above description, it should be evident that the connector according to the invention offers several advantages including:

(1) The possibility of arranging the fastening loop in the direction of traction exerted by the lever.

(2) The extreme simplicity and rapidity with which the loop can be connected to the anchoring element 2.

(3) The obtaining of an aesthetically desirable appearance.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a ski boot, a vamp section, a connector for a boot fastening loop molded integrally with the vamp section and rising from the exterior face of the vamp section, said connector provided in its outer face with an arcuate groove extending from side-to-side of the connector, and said groove having a restricted entrance slot through which a boot fastening loop may be engaged in the arcuate groove by being snapped through the restricted entrance slot, the entrance slot opening through the outer face of said connector.

2. In a ski boot as defined in claim 1, wherein said connector is a divided boss molded on the vamp section and said arcuate groove is formed between two opposing arcuate faces of the boss, the bottom of the groove being substantially flush with the exterior face of the vamp section.

3. In a ski boot as defined in claim 2, wherein said restricted entrance slot of the groove being at the top of the groove away from the exterior face of the vamp section and the entrance slot including a central portion which deviates laterally from the longitudinal path of the groove.

4. In a ski boot as defined in claim 1, and a central tooth element on one part of said divided boss arranged in interfitting spaced relation with a notch in the other part of the divided boss to thereby form a center deviation in said restricted entrance slot which is laterally offset from the main path of said groove.

* * * * *